US010799945B2

(12) United States Patent
Nakano et al.

(10) Patent No.: US 10,799,945 B2
(45) Date of Patent: Oct. 13, 2020

(54) DIE CASTING APPARATUS

(71) Applicant: TOYOTA JIDOSHA KABUSHIKI KAISHA, Toyota-shi (JP)

(72) Inventors: Hiroyoshi Nakano, Toyota (JP); Yuji Inoue, Anjo (JP); Shingo Ogura, Hekinan (JP); Yuta Tanaka, Hekinan (JP); Toshimitsu Yamada, Miyako-gun (JP); Yutaka Yoshida, Kitakyushu (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 2 days.

(21) Appl. No.: 16/406,518

(22) Filed: May 8, 2019

(65) Prior Publication Data

US 2020/0001357 A1 Jan. 2, 2020

(30) Foreign Application Priority Data

Jun. 28, 2018 (JP) ..... 2018-123579

(51) Int. Cl.

| | |
|---|---|
| ***B22D 17/22*** | (2006.01) |
| ***B22C 9/08*** | (2006.01) |
| ***B22D 17/04*** | (2006.01) |

(52) U.S. Cl.

CPC ..... *B22D 17/2272* (2013.01); *B22C 9/082* (2013.01); *B22D 17/04* (2013.01); *B22D 17/229* (2013.01)

(58) Field of Classification Search

CPC ..... B22D 17/2245; B22D 17/2272; B22D 17/2281; B22D 17/229

See application file for complete search history.

(56) References Cited

FOREIGN PATENT DOCUMENTS

| | | | | |
|---|---|---|---|---|
| JP | 59097749 A | * | 6/1984 | ..... B22D 17/22 |
| JP | 2004-098148 | | 4/2004 | |
| JP | 2004-209484 | | 7/2004 | |
| JP | 2005-152924 | | 6/2005 | |
| JP | 2007326114 A | * | 12/2007 | |
| JP | 2012-101256 | | 5/2012 | |
| JP | 2015-193031 | | 11/2015 | |

* cited by examiner

*Primary Examiner* — Kevin E Yoon
*Assistant Examiner* — Jacky Yuen
(74) *Attorney, Agent, or Firm* — Oblon, McClelland, Maier & Neustadt, L.L.P.

(57) ABSTRACT

A die casting apparatus according to an aspect of the present disclosure includes a sleeve 30 to which molten metal is supplied, and dies 10 and 20 configured to form a cavity C, in which the molten metal supplied to the sleeve 30 is injected into the cavity C through a runner R linking the sleeve 30 with the cavity C. A plurality of protrusions 22 are provided in the runner R, the plurality of protrusions 22 extending in a direction in which the molten metal flows and being arranged in a comb-teeth arrangement in a width direction of the runner R.

2 Claims, 7 Drawing Sheets

DIE CASTING APPARATUS

CROSS REFERENCE TO RELATED APPLICATIONS

This application is based upon and claims the benefit of priority from Japanese patent application No. 2018-123579, filed on Jun. 28, 2018, the disclosure of which is incorporated herein in its entirety by reference.

BACKGROUND

The present disclosure relates to a die casting apparatus.

As disclosed in, for example, Japanese Unexamined Patent Application Publication No. 2015-193031, in a die casting apparatus, after molten metal is supplied to a plunger sleeve, a plunger tip is moved forward inside the plunger sleeve, so that the molten metal is injected into a cavity of a die. When the molten metal is supplied to the plunger sleeve, part of the molten metal that has come into contact with the plunger sleeve is cooled and solidified. Therefore, initial solidified pieces are formed on contact surfaces between the molten metal and the plunger sleeve. If these initial solidified pieces come off from the plunger sleeve when the plunger tip is moved forward inside the plunger sleeve, and are injected into the cavity of the die together with the molten metal, they could cause a casting defect.

SUMMARY

The present inventors have diligently studied the above-described matter to reduce casting defects caused by initial solidified pieces in cast articles manufactured by a die casting apparatus, and found the following problem.

The inventors provided columnar protrusions in a runner (i.e., a channel for molten metal) that link a plunger sleeve with a cavity of a die in an attempt to reduce casting defects caused by initial solidified pieces, and have found that these protrusions had a certain level of effect of reducing such casting defects. This is presumably because the initial solidified pieces collide with the protrusions and are pulverized or they are pulverized by turbulence of the flow of the molten metal caused by the protrusions. However, there was a problem that since the protrusions had a columnar shape, they were easily broken as they were repeatedly pressed by the molten metal at a high pressure, and therefore durability of the die was insufficient.

The present disclosure has been made in view of the above-described circumstances and an object thereof is to provide a die casting apparatus which is capable of reducing casting defects caused by initial solidified pieces and whose die has excellent durability.

A first exemplary aspect is a die casting apparatus including:

a sleeve to which molten metal is supplied; and a die configured to form a cavity, in which the molten metal supplied to the sleeve is injected into the cavity through a runner linking the sleeve with the cavity, and a plurality of protrusions are provided in the runner, the plurality of protrusions extending in a direction in which the molten metal flows and being arranged in a comb-teeth arrangement in a width direction of the runner.

In the die casting apparatus according to the present disclosure, the plurality of protrusions are provided in the runner and extend in the direction in which the molten metal flows. Therefore, even when the protrusions are repeatedly pressed by the molten metal at a high pressure, they are less likely to be broken. Therefore, the die has excellent durability. Further, the plurality of protrusions are arranged in the comb-teeth arrangement in the width direction of the runner. Therefore, initial solidified pieces contained in the molten metal are pulverized by the protrusions or turbulence of the flow caused by the protrusions, and hence it is possible to reduce casting defects caused by the initial solidified pieces. That is, the die casting apparatus according to the present disclosure can reduce casting defects caused by initial solidified pieces and its die has excellent durability.

A height of the plurality of protrusions may be equal to a depth of the runner. By the above-described configuration, it is possible to reduce the casting defects caused by the initial solidified pieces even further.

A cross-sectional shape of each of the plurality of protrusions may be a triangular shape in which a width of a base of the protrusion is larger than that of a top thereof. The base of the protrusion is stabilized and as compared to, for example, a protrusion having a rectangular cross section, the protrusion having the triangular shape is less likely to be broken.

The plurality of protrusions may be formed in an insert part engaged with the die. It is possible to, when the protrusion is broken, replace only the insert part in which the protrusion is formed, thus making the die excellent in terms of the maintenance.

According to the present disclosure, it is possible to provide a die casting apparatus which is capable of reducing casting defects caused by initial solidified pieces and whose die has excellent durability.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Specific embodiments to which the present disclosure is applied will be described hereinafter in detail with reference to the drawings. However, the present disclosure is not limited to the below-shown embodiments. Further, the following descriptions and drawings are simplified as appropriate for clarifying the explanation.

First Embodiment

<Overall Configuration of Die Casting Apparatus>

Figure 1:
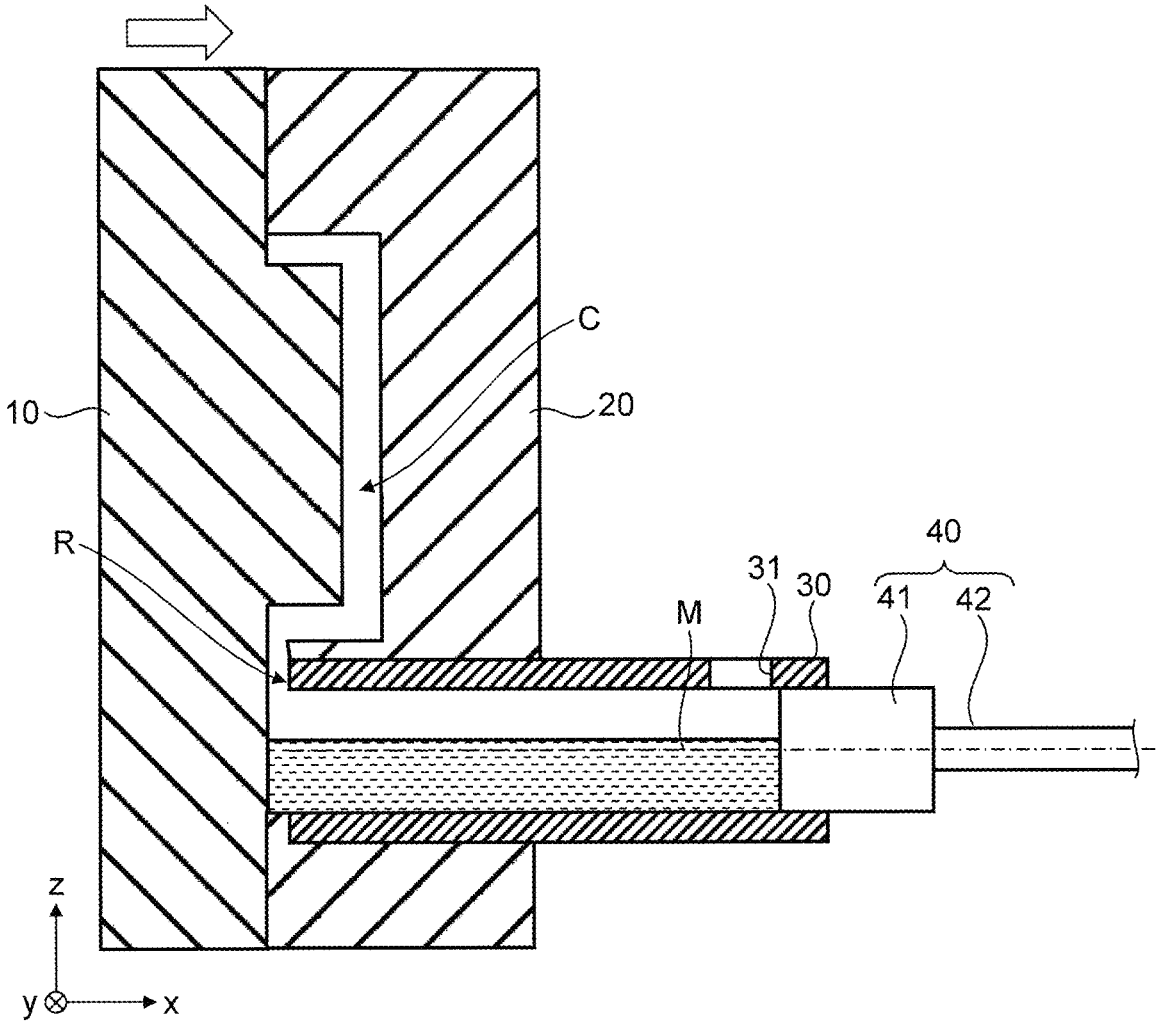
FIG. 1 is a schematic cross section of a die casting apparatus.
Figure 2:
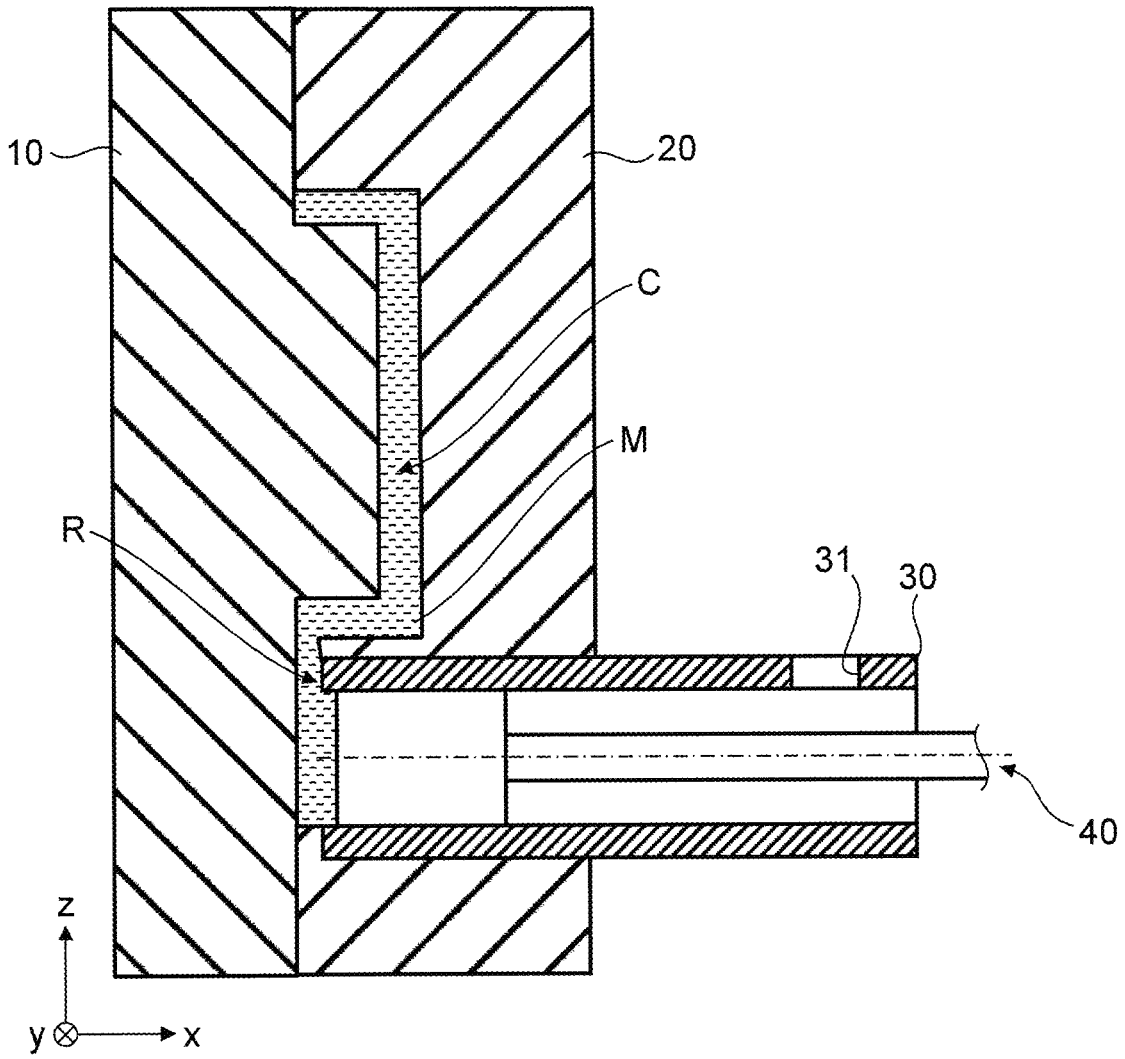
FIG. 2 is a schematic cross section of the die casting apparatus.
Figure 3:
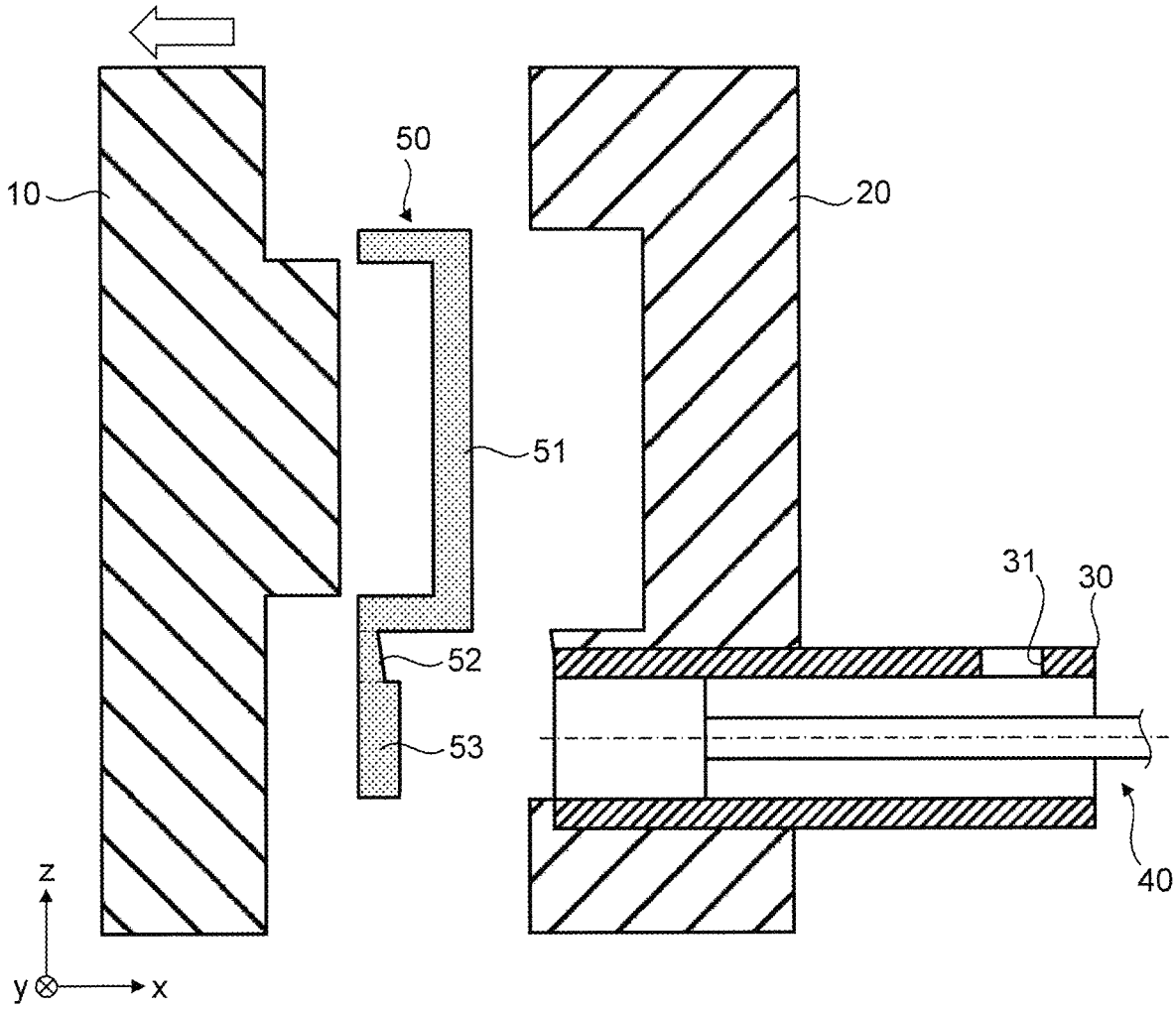
FIG. 3 is a schematic cross section of the die casting apparatus.

Firstly, an overall configuration of a die casting apparatus according to a first embodiment is described with reference to FIGS. 1 to 3. FIGS. 1 to 3 are schematic cross sections of the die casting apparatus.

Note that, needless to say, right-handed xyz orthogonal coordinate systems shown in FIG. 1 and other drawings are shown for the sake of convenience to explain positional relations among components. In general, a z-axis positive direction is a vertically upward direction and an xy-plane is a horizontal plane. These facts are applicable throughout the drawings.

As shown in FIGS. 1 to 3, the die casting apparatus according to the first embodiment includes a movable die 10, a fixed die 20, a plunger sleeve 30, and a plunger 40. Note that FIGS. 1 to 3 show operations of the die casting apparatus. FIG. 1 shows a state in which molten metal M is supplied to the plunger sleeve 30 in the die casting apparatus. FIG. 2 shows a state in which an injection of the molten metal M into a cavity C has been completed in the die casting apparatus. FIG. 3 is a schematic cross section showing a state in which a cast article 50 is taken out from the dies (the movable and fixed dies 10 and 20) in the die casting apparatus.

The movable die 10 is a die that can be moved in a sliding manner in the x-axis direction. Meanwhile, the fixed die 20 is a die fixed to the die casting apparatus. As the movable die 10 moves in the x-axis positive direction and abuts against the fixed die 20, a cavity C whose shape conforms to the shape of a product to be cast is formed between the movable and fixed dies 10 and 20 as shown in FIG. 1. As shown in FIG. 2, as the cavity C is filled with molten metal M, a cast article 50 is cast as shown in FIG. 3. Then, as the movable die 10 moves in the x-axis negative direction and is released from the fixed die 20, the cast article 50 can be taken out as shown in FIG. 3.

The movable and fixed dies 10 and 20 are made of, for example, alloy tool steel for hot dies. Note that each of the movable and fixed dies 10 and 20 may be an insert die.

For example, as shown in FIG. 1, a through hole having a circular cross section and having a central axis parallel to the x-axis is formed in the fixed die 20. A cylindrical plunger sleeve 30 is engaged inside this through hole. The plunger 40 slides in the x-axis direction inside the plunger sleeve 30. On the upper side of the plunger sleeve 30 at the end thereof on the side of the movable die 10 (i.e., at the end on the x-axis negative direction side), a runner (i.e., a channel for molten metal) R is formed between the movable and fixed dies 10 and 20. The runner R links the plunger sleeve 30 with the cavity C and guides molten metal M into the cavity C.

The plunger sleeve 30 is a cylindrical member having a central axis parallel to the x-axis. As described above, the plunger sleeve 30 is engaged inside the through hole formed in the fixed die 20. Molten metal M is fed into the plunger sleeve 30. A molten-metal inlet 31 for pouring molten metal M into the plunger sleeve 30 is formed in an area on the upper surface of the plunger sleeve 30 near the rear end thereof (i.e., near the end on the x-axis positive direction side). The molten metal M is poured through the molten-metal inlet 31 into the plunger sleeve 30 by using, for example, a ladle or the like (not shown). The plunger sleeve 30 is made of, for example, alloy tool steel for hot dies.

The plunger 40 includes a plunger tip 41 and a plunger rod 42.

The plunger tip 41 is a columnar member that directly comes into contact with the molten metal M contained in the plunger sleeve 30. The plunger tip 41 is connected to a drive source (not shown) through the plunger rod 42, which is a rod-like member having a central axis parallel to the x axis, and can slide in the x-axis direction inside the plunger sleeve 30. As shown in FIG. 2, as the plunger tip 41 slides from the rear end of the plunger sleeve 30 in the x-axis negative direction, the molten metal M, which has been fed into the plunger sleeve 30, is injected into the cavity C.

<Operation of Die Casting Apparatus>

Next, operations of the die casting apparatus according to the first embodiment are described with reference to FIGS. 1 to 3. Firstly, as shown in FIG. 1, in a state where the plunger tip 41 is retracted in the x-axis positive direction inside the plunger sleeve 30, the movable die 10 is made to abut against the fixed die 20, so that a cavity C is formed therebetween. Then, molten metal M is supplied through the molten-metal inlet 31 of the plunger sleeve 30 into the plunger sleeve 30 by using, for example, a ladle or the like (not shown).

Next, as shown in FIG. 2, the plunger 40 is moved forward inside the plunger sleeve 30, so that the molten metal M is injected into the cavity C through the runner R. Note that by moving the plunger 40 forward, it is possible to fill the cavity C with the molten metal M while pressing the molten metal M.

Next, as shown in FIG. 3, after the molten metal M is solidified inside the cavity C, the movable die 10 is released from the fixed die 20 and a cast article 50 is take out. As shown in FIG. 3, the cast article 50 includes a runner part 52 and a biscuit part 53 in addition to a product part 51. Dashed lines in the cast article 50 shown in FIG. 3 are drawn for the sake of explanation in order to indicate boundary lines between the product part 51 and the runner part 52 and between the runner part 52 and the biscuit part 53.

The runner part 52 is a part where the molten metal M is solidified in the runner R. The biscuit part 53 is a part where the molten metal M surrounded by the front-end surface of the plunger tip 41 and the dies (the movable and fixed dies 10 and 20) is solidified. Note that the runner part 52 and the biscuit part 53 are eventually removed and the product part 51 is used as a product.

Note that as described above, when molten metal M is supplied to the plunger sleeve 30, part of the molten metal M that has come into contact with the plunger sleeve 30 is cooled and solidified. Therefore, initial solidified pieces are formed on the inner surface of the plunger sleeve 30 that has come into contact with the molten metal M. If these initial solidified pieces come off from the plunger sleeve 30 when the plunger tip 41 is moved forward inside the plunger sleeve 30, and are injected into the cavity C of the dies (the movable and fixed dies 10 and 20) together with the molten metal M, they could cause casting defects.

As will be described below, in the die casting apparatus according to the first embodiment, protrusions for reducing casting defects caused by initial solidified pieces are provided in the runner R.

<Configuration of Runner in Die>

Figure 4:
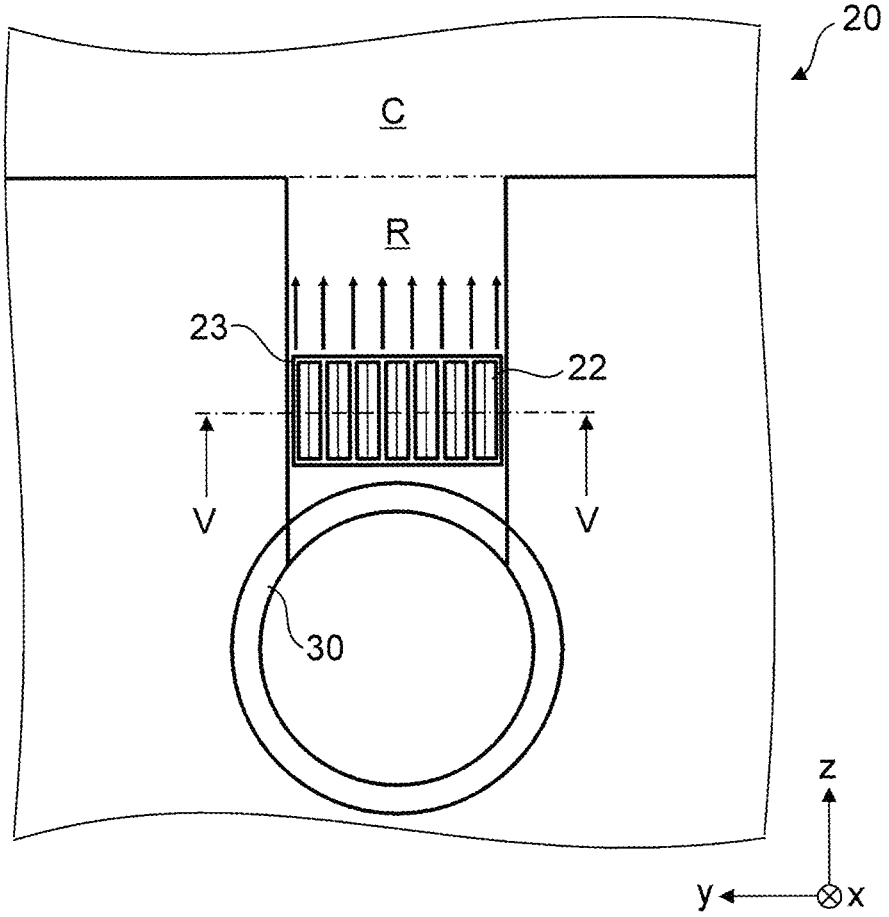
FIG. 4 is a front view of a part of a fixed die 20.
Figure 5:
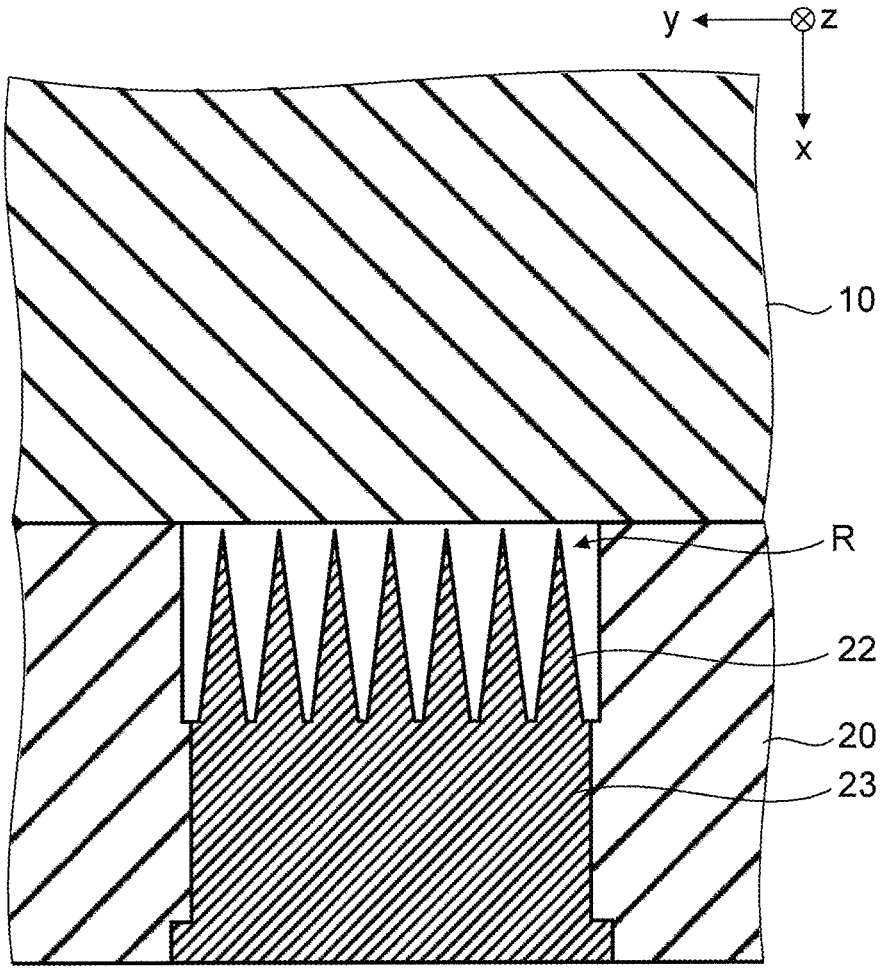
FIG. 5 is a cross section taken along a line V-V in FIG. 4.

Next, a configuration of the runner R, which links the plunger sleeve 30 with the cavity C of the dies (the movable and fixed dies 10 and 20), in the die casting apparatus according to the first embodiment is described with reference to FIGS. 4 and 5. FIG. 4 is a front view of a part of the fixed die 20. FIG. 5 is a cross section taken along a line V-V in FIG. 4. A part of the movable die 10 is also shown in FIG. 5. In the examples shown in FIGS. 4 and 5, a groove-like runner R is formed in the fixed die 20 and the plunger sleeve 30. However, the runner R may be formed in the movable die 10, or may be formed in both the movable and fixed dies 10 and 20.

As shown in FIGS. 4 and 5, the groove-like runner R for guiding injected molten metal to the cavity C is formed on the end surface of the plunger sleeve 30 and the front surface of the fixed die 20. The runner R is formed so as to extend from the inner peripheral surface of the plunger sleeve 30 to the cavity C. Further, a plurality of protrusions 22 are provided so as to extend along the longitudinal direction of the runner R, i.e., along a direction in which the molten metal flows (the z-axis positive direction in the example shown in FIG. 4). In the example shown in FIG. 4, seven protrusions 22 are provided.

Further, the plurality of protrusions 22 are arranged in a comb-teeth arrangement in the width direction of the runner R. Although each of the protrusions 22 shown in FIG. 4 has a triangular cross section, i.e., has a wedge shape (a triangular prism shape), the shape of the protrusion 22 is not limited the triangular shape. For example, the protrusion 22 may have a rectangular cross section, i.e., a quadrangular prism shape. It should be noted, however, since the cross-sectional shape of the protrusion 22 is triangular, the width of the base of the protrusion 22 is larger than the top thereof. Therefore, the base of the protrusion 22 is more stable than, for example, that of a protrusion having a rectangular cross section. Further, a resistance that is caused when a cast article is taken out from the die is reduced and hence the cast article is less likely to be damaged. Note that in the example shown in FIG. 5, the top of the protrusion 22 having the triangular cross section has a shape having an acute angle. However, the top of the protrusion 22 may have an R-shape or may be flat.

By forming a plurality of protrusions 22 arranged in a comb-teeth arrangement in the width direction of the runner R, it is possible to reduce casting defects caused by initial solidified pieces. As indicated by arrows in FIG. 4, the molten metal passes between the protrusions 22 while colliding with the protrusions 22. Therefore, it is presumed that initial solidified pieces contained in the molten metal collide with the protrusions 22 and hence are pulverized, or they are pulverized by turbulence of the flow of the molten metal caused by the protrusions 22.

Note that the protrusions 22 are provided so as to extend along the direction in which the molten metal flows. That is, the length (the length in the z-axis direction) of each protrusion 22 is larger than the width (the length in the y-axis direction) of the protrusion 22. Therefore, even when the protrusions 22 are repeatedly pressed by the molten metal at a high pressure, they are less likely to be damaged as compared to, for example, columnar protrusions. Therefore, the die (the fixed die 20 in the example shown in FIGS. 4 and 5) has excellent durability. For example, the length of each protrusion 22 is preferably at least twice the width of the protrusion 22. Alternatively, the length of each protrusion 22 is preferably at least one half of the height of the protrusion 22.

For the reduction of casting defects caused by initial solidified pieces, the higher the protrusions 22 are, the more they are preferred. For example, the height of each protrusion 22 is preferably at least 80% of the depth of the runner R, and more preferably at least 90% of the depth of the runner R. Therefore, as shown in FIG. 5, the height of each protrusion 22 is most preferably equal to the depth of the runner R. However, the height of the protrusions 22 is not limited to such a height. Note that the expression that the height of the protrusion 22 is equal to the depth of the runner R does not means that the height of the protrusion 22 is exactly equal to the depth of the runner R. That is, this expression also includes cases where the height of the protrusion 22 is roughly equal to the depth of the runner R.

Further, as shown in FIGS. 4 and 5, all the protrusions 22 are formed in an insert part 23. In other words, the bases of all the protrusions 22 are integrally formed with the insert part 23. Further, the insert part 23 is engaged with and fixed to the fixed die 20. That is, the protrusions 22 are provided in the replaceable insert part 23. Therefore, when the protrusions 22 (e.g., some of the protrusions 22) are broken, it is possible to replace only the insert part 23 in which the protrusions 22 are provided, thus making the die excellent (e.g., useful) in terms of the maintenance. Needless to say, the protrusions 22 may be integrally formed with the fixed die 20 or the movable die 10.

As described above, in the die casting apparatus according to the first embodiment, the plurality of protrusions 22, which extend in the direction in which the molten metal flows, are formed in the runner R. Therefore, even when the protrusions 22 are repeatedly pressed against the molten metal at a high pressure, they are less likely to be broken. Therefore, the die has excellent durability. Further, the plurality of protrusions 22 are arranged in a comb-teeth arrangement in the width direction of the runner R. Therefore, initial solidified pieces contained in molten metal are pulverized by the protrusions 22 or turbulence of the flow caused by the protrusions 22, and hence it is possible to reduce casting defects caused by the initial solidified pieces. That is, the die casting apparatus according to the first embodiment can reduce casting defects caused by initial solidified pieces and its die has excellent durability.

EXAMPLE

The die casting apparatus according to the first embodiment will be described hereinafter in a more detailed manner by using examples and comparative examples. However, the die casting apparatus according to the first embodiment is not limited to the examples shown below.

Figure 6:
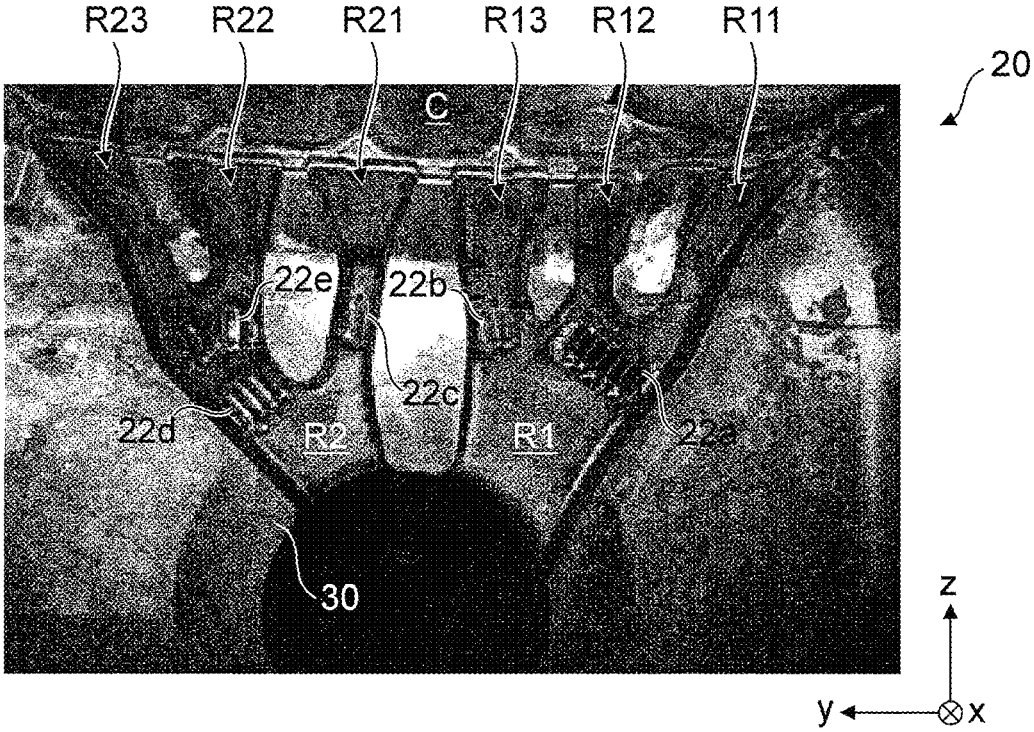
FIG. 6 is a photograph of a front view of a part of a fixed die 20 in a die casting apparatus according to an example of a first embodiment.

FIG. 6 is a photograph of a front view of a part of a fixed die 20 in a die casting apparatus according to an example of the first embodiment. In the example shown in FIG. 6, two runners R1 and R2 are formed on the front surface of the fixed die 20, which will be made to abut against a movable die 10, in such a manner that the runners R1 and R2 extend from the inner peripheral surface of the plunger sleeve 30 to the cavity C while the distance between the runners R1 and R2 increases as they extend toward the cavity C.

The runner R1 branches into three runners R11, R12 and R13, and these runners R11, R12 and R13 reach the cavity C while the distances between them increase as they extend toward the cavity C. The runner R2 branches into three runners R21, R22 and R23, and these runners R21, R22 and R23 reach the cavity C while the distances between them increase as they extend toward the cavity C. That is, the six runners R11, R12, R13, R21, R22 and R23 are formed so as to spread roughly in a radial pattern from the inner peripheral surface of the plunger sleeve 30.

In a part of the runner R1 where it branches into the runners R11 and R12, seven protrusions 22*a* are provided so as to extend along the direction in which molten metal flows. The seven protrusions 22*a* are arranged in a comb-teeth arrangement in the width direction of the runners R11 and R12.

In the runner R13, two protrusions 22*b* are provided so as to extend along the direction in which the molten metal flows. The two protrusions 22*b* are arranged in a comb-teeth arrangement in the width direction of the runner R13.

In the runner R21, one protrusion 22*c* is formed so as to extend along the direction in which the molten metal flows.

In a part of the runner R2 where it branches into the runners R22 and R23, four protrusions 22*d* are provided so as to extend along the direction in which the molten metal flows. Further, another four protrusions 22*e* are formed on the downstream side thereof. That is, the four protrusions 22*d* and the four protrusions 22*e*, each of which are arranged in a comb-teeth arrangement in the width direction of the runners R22 and R23, are formed in two stages (i.e., in an end-to-end arrangement).

The dimensions of each protrusion in the example were as follows: the length of the base was 21 mm; the width of the base was 5 mm; and the height was 14 mm.

In the example shown in FIG. 6, it was possible to drastically reduce the area ratio of initial solidified pieces in a produced cast article from 5.8% to 1.3% as compared to a comparative example in which no protrusion was provided in the runner. As described above, by providing a plurality of protrusions arranged in a comb-teeth arrangement in the width direction of the runner in the runner, it was possible to reduce casting defects caused by initial solidified pieces. Further, the protrusions are provided so as to extend along the direction in which molten metal flows. Therefore, even when the protrusions 22 are repeatedly pressed against the molten metal at a high pressure, they are less likely to be broken. Therefore, the die has excellent durability.

Figure 7:
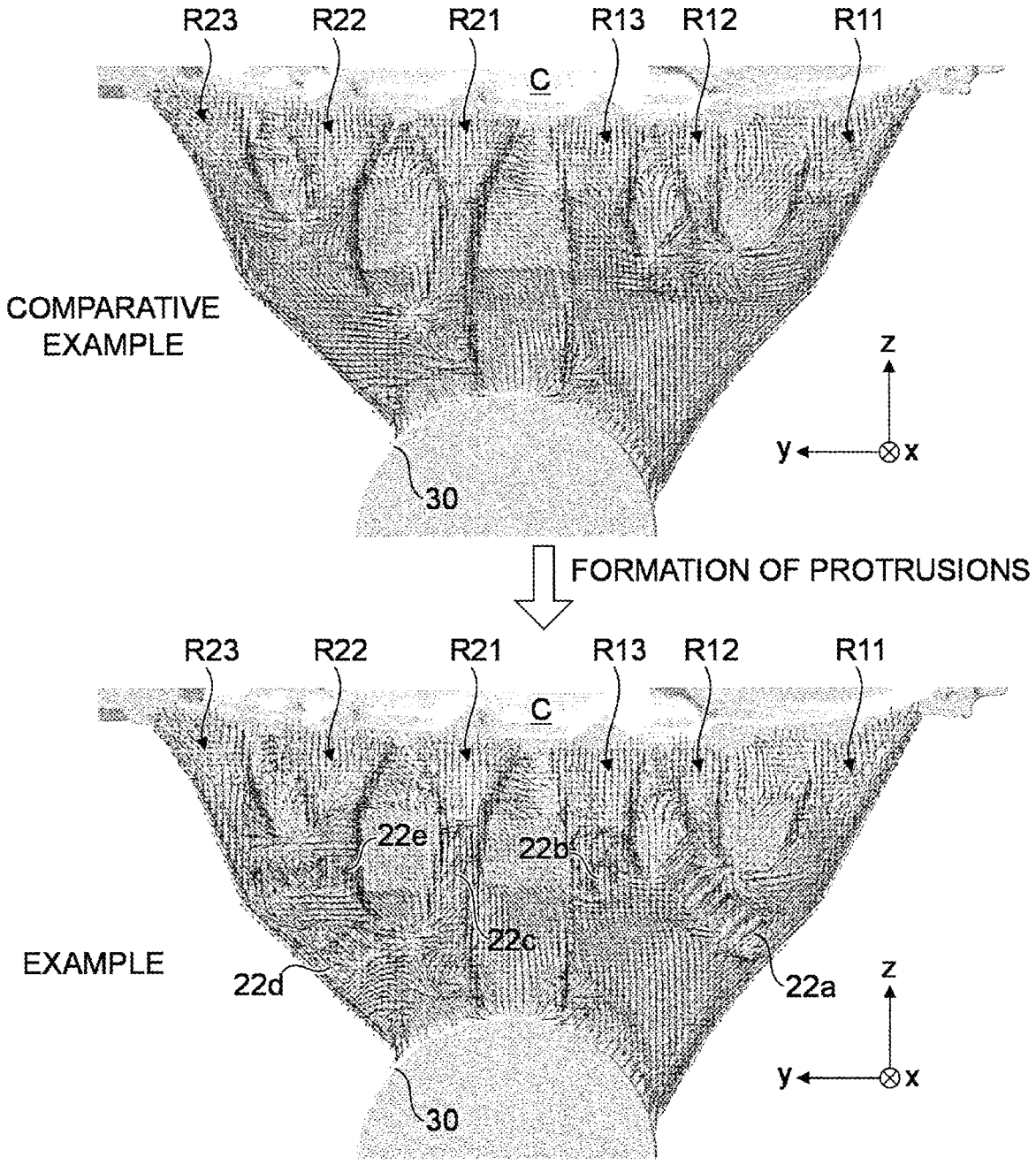
FIG. 7 shows a result of a computer simulation of changes in a flow of molten metal caused by formation of protrusions.

Note that FIG. 7 shows a result of a computer simulation of changes in a flow of molten metal caused by formation of protrusions. As shown in FIG. 7, the flow of the molten metal that has passed through the protrusions 22*a*, 22*b*, 22*c*, 22*d* and 22*e* is disturbed in the example as compared to the comparative example in which no protrusion is provided in the runner. Based on the simulation result shown in FIG. 7, it is presumed that initial solidified pieces contained in the molten metal collide with the protrusions and hence are pulverized, or they are pulverized by turbulence of the flow caused by the protrusions.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A die casting apparatus comprising:

a sleeve to which molten metal is supplied; and a die configured to form a cavity, wherein the molten metal supplied to the sleeve is injected into the cavity through a runner linking the sleeve with the cavity, a plurality of protrusions are provided in the runner, the plurality of protrusions extending in a direction in which the molten metal flows and being arranged in a comb-teeth arrangement in a width direction of the runner, a height of the plurality of protrusions is at least 90% of a depth of the runner, a cross-sectional shape of each of the plurality of protrusions is a triangular shape in which a width of a base of the protrusion is larger than that of a top of the protrusion, and a cross-sectional shape of each gap formed between the plurality of adjacent protrusions is triangular shape.

2. The die casting apparatus according to claim 1, wherein the plurality of protrusions are formed in an insert part engaged with the die.

* * * * *